United States Patent [19]
Sigott et al.
[11] 4,263,005
[45] Apr. 21, 1981

[54] DEVICE FOR PROVISIONALLY CONSOLIDATING A GALLERY AND SUITABLE CONSOLIDATING FRAME

[75] Inventors: Siegfried Sigott; Otto R. Schetine; Alfred J. Zitz, all of Zeltweg; Wilhelm F. Althaler, Vienna, all of Austria

[73] Assignee: Vereinigte Osterreichische Eisen-und Stahlwerke - Alphine Montan Aktiengesellschaft, Vienna, Austria

[21] Appl. No.: 951,255

[22] Filed: Oct. 13, 1978

[30] Foreign Application Priority Data

Oct. 13, 1977 [AT] Austria ..... 7327/77
Jun. 9, 1978 [AT] Austria ..... 4212/78

[51] Int. Cl.[3] ..... E21D 13/04; E21D 15/02
[52] U.S. Cl. ..... 405/303; 405/150; 405/288; 173/147
[58] Field of Search ..... 405/288, 150, 151, 146, 405/303; 248/356, 357; 173/147; 299/47, 48

[56] References Cited

U.S. PATENT DOCUMENTS 2,738,081 3/1956 Lee ..... 173/147 X
2,749,713 6/1956 Paurat ..... 405/288
3,205,951 9/1965 Pyles ..... 173/147 X
3,741,315 6/1973 Hilton ..... 173/147 X
3,885,397 5/1975 Fujimori ..... 405/288
4,095,434 6/1978 Hunter et al. ..... 405/288

*Primary Examiner*—Dennis L. Taylor
*Attorney, Agent, or Firm*—Cushman, Darby & Cushman

[57] ABSTRACT

The invention refers to a device with which provisional consolidating frames adapted to be brought to a smaller size can be transported to the drift face and can be put in place. According to the invention this device is arranged on the cutting machine itself so that the narrow space remaining between the contour of the cutting machine and the cross section of the drift is sufficient for transporting in forward direction and putting in place the provisional consolidating frames without the necessity to retract the face advancement machine from the drift face. Thus, face advancement machines can be used which occupy the major part of the inside width of the drift, noting that the face advancing machine is maintained in its working position. The invention further describes a door-jamb frame for the provisional drift consolidation and which is particularly suitable for the device proposed.

15 Claims, 9 Drawing Figures

DEVICE FOR PROVISIONALLY CONSOLIDATING A GALLERY AND SUITABLE CONSOLIDATING FRAME

The present invention refers to a device for provisionally or temporarily consolidating a gallery or drift or tunnel, advanced by means of a face advancement machine such as a cutting machine, near the face thereof by means of provisional frames, the frame size of which can be reduced to a size within the inside width of the frames put in place and outside the largest cross sectional profile of the face advancement machine, noting that a transport equipment for transporting the frames, having been reduced to a smaller frame size, in longitudinal direction of the gallery or drift or tunnel within the interspace between the provisional frames put in place and the face advancement machine is provided for engaging the caps of the provisional frames. Additionally, the invention refers to a consolidating frame suitable to be used together with such a device. It is already known to design provisional consolidating frames such that their size can be reduced to a size within the inside width of consolidating frames already put in place. Known devices for transporting and erecting such consolidating frames are suspended on the roof and must, therefore, separately be extended unto the drift face to be in the position to erect or put in place a further consolidating frame. It is further known to bring forward such consolidating frames by means of a separate vehicle. When using such a vehicle simultaneously with a face advancement machine standing in front of the face, the face advancement machine, e.g. cutting machine, must be kept relatively small and the space remaining between the contour of the face advancement machine and the consolidating frame already put in place must be kept relatively large. Cutting machines of modern construction have, however, a relatively great cross section as compared with the cross section of the gallery or drift or tunnel. The invention now aims at providing a device which allows to use a cutting machine of relatively great cross section, i.e. a cutting machine occupying the major portion of the cross section of the gallery or drift or tunnel, without the necessity to retract the cutting machine from the face when provisional consolidating frames are to be put in place.

For providing a solution for the problem being the object of the invention, a device of the kind described above is essentially characterized in that the transport device is provided on the face advancement machine itself. Such an arrangement makes it possible to keep free between the contour of the cutting machine and the consolidating frames already put in place only the space for the consolidating frames having been reduced in size. This provides the advantage that when advancing the face advancement machine the transport device need not be separately brought into a new position. Preferably, the arrangement is such that the transport device comprises a longitudinal carrier arranged on the face advancement machine and a feed carrier arranged for being moved on the longitudinal carrier in direction to the face, a transport car for the frames having been reduced to a smaller frame size being provided on said carriers. This feed carrier allows to transport a frame just in front of the face so that the roof can be supported immediately in front of the face without obstructing operation of the cutting machine. It is only necessary to move the cutting arm of the cutting machine in downward direction when bringing forward a frame.

Conveniently a cable line or chain line is provided for shifting the feed carrier and for moving the transport car. In this case and according to a preferred embodiment of the invention, the arrangement is such that a drum for the tension member (cable or chain) is provided on the longitudinal carrier arranged on the face advancement machine, in that the tension member is guided around a guide pulley bearingly supported on the front end of said longitudinal carrier and over a guide pulley rotatably supported on the rearward end of the feed carrier and, from said latter guide pulley, is guided around a guide pulley rotatably supported on the forward end of the feed carrier and then linked to the transport car preferably being movable only on the feed carrier. In this manner, by winding the tension member on the drum, the feed carrier as well as the transport car can be moved from the position in which a dismantled frame is put onto the transport car into the position in which this frame shall be placed in front of the face. The construction can be simplified if the transport car is arranged to be moved on the feed carrier only, because a uniform path of travel is provided for the transport car. The transport car can thus be brought from one position into the other by advancing the feed carrier as well as by being moved on this feed carrier. According to the invention a further drum for a tension member connected to the transport car can be provided on the rearward end of the longitudinal carrier arranged on the face advancement machine for retracting the transport car, noting that movement of the transport car is delimited by means of a stop arranged on the rearward end of the feed carrier. The transport car is being retracted by means of said tension member and is engaging the stop arranged at the rearward end of the feed carrier and is thus returning the feed carrier into its starting position. In this case and according to the invention, both drums can be arranged on a common drive shaft in a freely rotatable manner and a clutch can be provided for selectively coupling one of both drums with the drive shaft, noting that the tension members are wound on the drums in opposite winding direction. By switching over this clutch, the advancement movement and the retracting movement of the transport car together with the feed carrier can be effected.

The face advancement machine is not always assuming an exact centre position within the gallery or drift or tunnel. However, the caps shall be engaged in their middle portion by the support of the transport car. For this purpose and according to the invention, the support for the cap can be arranged on the transport car for being shifted in lateral direction. In this case, the arrangement is conveniently such that the support for the cap is formed of two forks which are pivoted to the transport car for being pivoted in lateral direction, noting that, if desired, the pivotal joints of these forks are arranged on the transport car for being shifted in lateral direction.

By downwardly swivelling these forks it can be achieved that the forks not used do not or only slightly protrude above the contour of the face advancement machine.

A further development of the invention essentially consists in that the longitudinal carrier is arranged for being swivelled by means of an adjusting device supported against the face advancement machine around a horizontal transverse axis on the face advancement machine, said transverse axis being arranged between the rearward end of the longitudinal carrier and the forward end of the completely advanced feed carrier and preferably being arranged in a middle area between said both ends. This allows to use the longitudinal carrier as an expedient for dismantling and erecting the provisional consolidating frames. This is of advantage in view of such provisional consolidating frames having a relatively high weight of for instance 500 kilogram. When dismantling a provisional consolidating frame being put in place at the rearward area of the face advancement machine, the rearward end of the longitudinal carrier is being lifted so that the consolidating frame to be dismantled can be supported by means of the longitudinal carrier. Subsequently, the rearward end of the longitudinal carrier is being lowered and the dismantled consolidating frame having also been brought to a smaller frame size is being transported in direction to the drift face, whereupon the forward end of the longitudinal carrier is moved in upward direction to be in the position to again put in place the consolidating frame in the area in front of the drift face. Thus, one can do without a separate erecting device for frames to be put in place, which erecting device could only with difficulties be brought into the area located in front of the face advancement machine. The adjustment device for swivelling the longitudinal carrier is preferably acting on the rearward portion of the longitudinal carrier, which is of advantage in view of sufficient stationary points being present in the rearward area of a cutting machine for linking thereto the adjustment device, whereas the possibilities for linking the adjustment device are less favourable in the front area of the cutting machine in view of the cantilevering cutting arm. Such an adjusting device can advantageously be formed of a hydraulic piston cylinder arrangement linked to the rearward end of the face advancement machine and to the longitudinal carrier.

According to a preferred embodiment of the invention, the feed carrier is formed of beams of U-shaped cross-section having their legs outwardly directed and being connected to form a frame, wheels of the transport car being guided between the legs of the beams, noting that the longitudinal carrier is formed of two beams of U-shaped cross section having their legs outwardly directed and being connected to form a frame, and noting that the feed carrier is guided between said both beams of the longitudinal carrier and is provided with wheels being guided between the legs of said both beams of the longitudinal carrier. The feed carrier can thus easily be moved on the longitudinal carrier and the transport car can be moved over the whole length of the feed carrier. When dismantling or removing the hindmost of the provisional consolidating frames located in the area rearward of the face advancing machine, the feed carrier is moved in its rearmost position and also the transport car is moved in its rearmost position on the feed carrier, so that the transport car, in the pivotal position of the longitudinal carrier in which the rearward end of the longitudinal carrier is swivelled in upward direction, can engage the provisional consolidating frame to be dismantled or removed. Transport in forward direction of the consolidating frame having been reduced to a smaller frame size can now be effected by completely moving the feed carrier in forward direction and moving the transport car in forward direction, whereupon the consolidating frame having been transported in forward direction can be placed or erected in a suitable distance ahead of the provisional consolidating frame, previously most adjacent erected in front of the drift face, by swivelling in upward direction the forward end of the longitudinal carrier and, therewith, also the feed carrier.

According to a practical embodiment of the invention, the wheels of the feed carrier are arranged at its rearward end, while wheels are bearingly supported on the forward end of the longitudinal carrier for supporting the feed carrier. The advantage of such a construction resides in that the distance between the two supporting points between longitudinal carrier and feed carrier becomes greater with the feed carrier not completely advanced and, therewith, the supporting action becomes more favourable and it becomes possible to operate in many cases also with the feed carrier not completely advanced.

Preferably, between the beams of U-shaped cross section a hydraulically operated cylinder piston arrangement is provided for advancing the feed carrier, the cylinder preferably being connected with the longitudinal carrier. Such a cylinder piston arrangement provides the possibility to precisely guide the feed carrier relative to the longitudinal carrier and to fix the feed carrier in its position so that the provisional consolidating frame having been moved in forward direction can be precisely put in place. In this case, the transport car can be connected with an endless cable or chain which is guided over guide pulleys bearingly supported on both ends of the feed carrier, one of the guide pulleys being a driven guide pulley. Such a guide pulley can, for example, be driven by a hydraulic motor and also in this case it is again possible to precisely maintain, during erecting the provisional consolidating frame, the transport car in its position by means of this motor.

A consolidating frame most suitable for being used with one of the devices according to the invention is designed as door-jamb frame having a straight cap adapted to be shortened in length. Such a provisional consolidating frame can in a simple manner be brought to a smaller frame size with which the frame can be moved even through a narrow space between the contour of the cutting machine on the one hand and the roof and, respectively, the props of consolidating frames already put in place, so that the consolidating frames can be put in place in a simple manner. The individual consolidating frames can be put in place with progressing excavation so that a freshly excavated drift portion can reliably be supported immediately after excavation. In view of the hindmost provisional consolidating frame being transported in direction to the drift face to again become erected there and in view of this provisional consolidating frame having been transported being substituted by the final drift consolidation, one can do with a predetermined number of such provisional consolidating frames. In view of the fact that these frames are completely assembled and must only be brought to a smaller size before being transported in forward direction to their new position, these frames can in a simple manner and rapidly be put in place. A maximum security can be obtained with a minimum of expenditure.

By the process according to the invention, which is principally different from the known progressive drift consolidation, the known disadvantages can be avoided which result from the so-called "trample effect". This "trample effect" can be observed if the consolidating frames are moved in forward direction according to the so-called "pilgrim step", with which the support for the drift roof is entirely removed over the whole length of the drift consolidating means movable in longitudinal direction of the drift and the caps of the drift consolidating means are again pressed against the roof in their new position.

According to the invention the door-jamb frame can be designed such that the cap consists of a centre portion and of two side portions slideably guided within the centre portion, noting that props are linked to the side portions and that the side portions are, if desired, slideably moveable relative to the centre portion by hydraulically or pneumatically operated cylinder piston arrangements.

According to the invention, a spring means, preferably a leaf spring can be provided which rests against cap and prop and is acting for swivelling the props in outward direction. Such a spring means is capable of supporting part of the weight of the props slightly inclined in outward direction when transporting the frames in forward direction, what facilitites the work of the operator.

According to the invention, the caps of adjacent consolidating frames are preferably adapted to be connected by length-adjustable distance rods, conveniently by hydraulically or pneumatically operated cylinder piston means. Such length adjustable rods are facilitating the adjustment of the distance of caps to be put in place relative to the previous cap. According to the invention it is also possible to provide rails extensible in working direction at the area of transition between the side walls of the drift and the floor of the drift, said rails being provided with engaging points such as holes, protrusions or the like for the lower ends of the props, said engaging points being arranged according to the mean distance of the frames. In this manner, the distance of the frames can precisely be determined at the drift roof as well as at the drift floor.

The consolidating frames according to the invention are of considerable weight. A practical embodiment of such a consolidating frame has a weight of approximately 700 kilogram. In view of the transport device supporting the weight of the consolidating frame, transport of the consolidating frames in forward direction as well as erecting the frames in their new position can, without further, be effected by two operators which must only guide the props linked to the cap in such a manner that the props do not touch the face advancement machine or consolidating frames already put in place. Erection of the consolidating frames in their new position in front of the drift face can easily be effected by hydraulic means. Therefore, and according to a preferred embodiment of the invention, hydraulic props are linked to the cap, which props can easily and rapidly be put in place.

The invention is further illustrated with reference to the drawing showing various embodiments.

FIG. 1 is a lateral view of the provisional drift consolidation as seen in direction of arrow 1 of FIG. 2 and FIG. 2 is a view of the drift consolidation in advancement direction, i.e. in direction of arrow II of FIG. 1.

Figure 1:
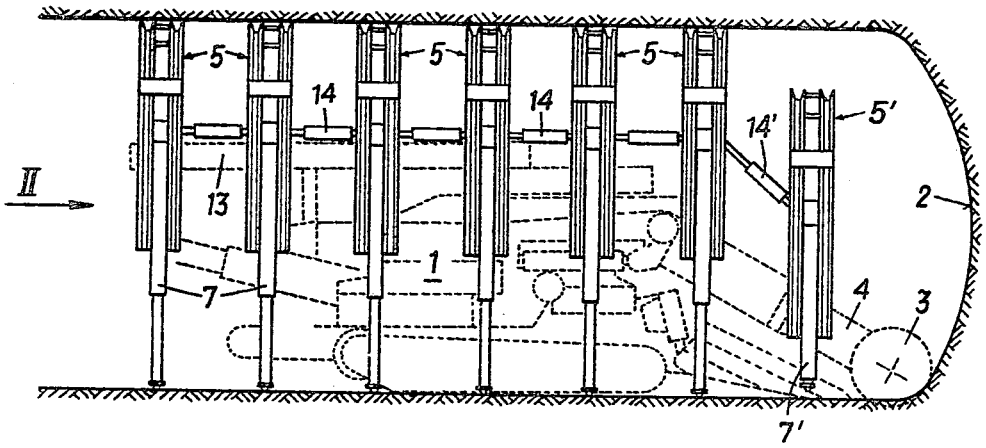
FIGS. 1 and 2 show a drift at the area of the face advancement machine, whereby
Figure 2:
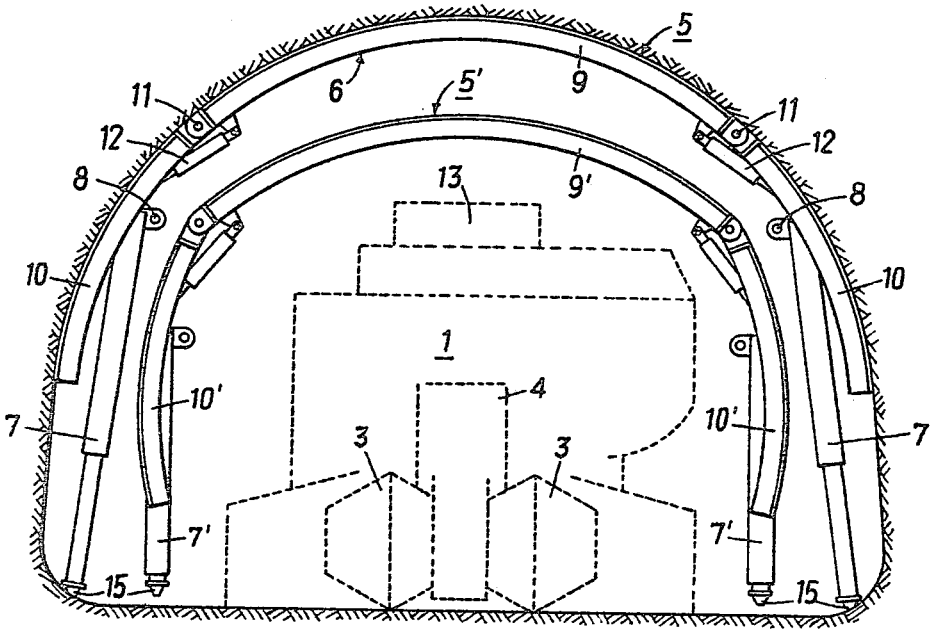

In FIGS. 1 and 2 only the essential contour of the face advancement machine 1 is indicated. The drift face is designated 2 and the cutting heads 3 are arranged on a universally pivotable arm 4. The drift roof and the side walls of the drift are supported by provisional consolidating frames 5 at the area of the cutting machine. These consolidating frames 5 consist of a cap 6 to which hydraulic props 7 are linked at both sides for being swivelled around pivotal joints 8. The cap 6 consists of a middle portion 9 to which lateral members 10 are linked for being swivelled around pivotal joints 11. The middle portion 9 and the lateral members 10 form an arc. The lateral members 10 are supported against the middle portion 9 by means of hydraulic cylinder piston arrangements 12 for being pressed against the upper area of the side walls of the drift.

Figure 3:
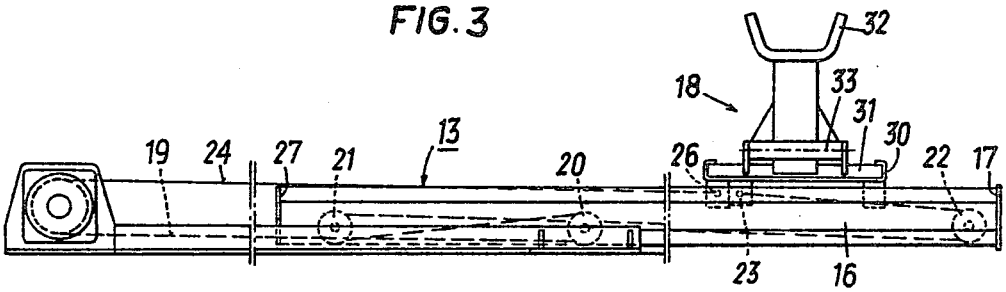
FIGS. 3 and 4 show the longitudinal carrier arranged on the face advancement machine together with the feed carrier and the transport car, FIG. 3 representing a lateral view and FIG. 4 representing a top plan view.
Figure 4:
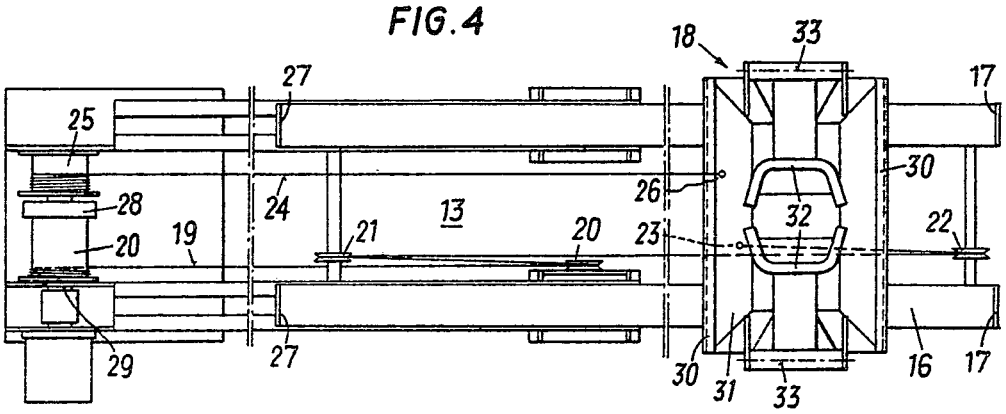

With progressing excavation, the frame most distant from the drift face 2 is removed by reducing the length of the props 7 and by retracting the pistons of the hydraulic cylinder piston arrangements 12. The size of the frames will thus be reduced to the size 5'. The middle portion will thus assume the position 9'. The lateral members will assume the position 10' and the props will assume the position 7'. In this position, the middle portion 9' of the cap 6 is resting on a transport car, noting that the carrier or support, on which the transport car can be moved, is only indicated by the reference numeral 13. The exact arrangement is shown in FIGS. 3 and 4.

The removed frame will now be moved in direction to the drift face by means of the transport car, noting that, as is illustrated by FIG. 2, the frame 5' being brought to a reduced size can without further pass through the interspace between the frames 5 put in place and the cutting machine 1. This frame 5 is moved to the drift face 2 with its reduced size 5' and is put in place there.

Rods formed of cylinder piston arrangements 14 are removeably connected to the caps and determine the distance between the caps. The frame 5' is connected to the adjacent frame 5 by such a cylinder-piston-arrangement 14'. When erecting this frame 5' so that it does assume the position of the frames 5 the distance between this frame and the adjacent frame is adjusted by this rod 14'. The lower ends 15 of the props 7 are provided with tips. These ends may be rested on the drift floor itself but it is also possible to provide a rail extensible in direction to the drift face 2, said rail being provided in locations corresponding to the mean distances of the frames 5 with holes to accommodate said ends 15, so that the distance is exactly defined by this rail on the one hand and the length adjustable rods 14 on the other hand.

The width of the caps 6 is 450 mm in a practical embodiment. Therefore, the frames 5 are relatively heavy and have, in a practical embodiment, a weight of approximately 700 kg. For this reason, the transport device is of essential importance.

The transport device is shown in FIGS. 3 and 4. The longitudinal carrier 13 or support is fixed to the cutting machine. A feed carrier 16 is supported on this longitudinal carrier for being shifted in a telescopic manner. The end 17 of this feed carrier can be advanced just near the drift face 2. A transport car or transport slide 18 is supported for being shifted on the feed carrier and can be moved unto the end 17. As is shown in the drawing, the longitudinal carrier 13 can be subdivided in two longitudinal carriers and the feed carriers 16 can be subdivided in two feed carriers, said carriers being mutually interconnected, noting that the transport car 18 is guided on the feed carrier 16 or on the feed carriers 16.

A tension member 19 is wound on a drum 20. This tension member 19 is guided around a guide pulley 20 pivotally supported at the front end of the longitudinal carrier 13, running to a guide pulley 21 bearingly supported on the rearward end of the feed carrier 16 and guided around the pulley 21 and is further running to a guide pulley 22 bearingly supported at the front end of the feed carrier 16 and guided around this guide pulley 22 for being connected to the transport car 18 at 23. By winding the tension member 19 onto the drum 20, the feed carrier 16 as well as the transport car 18 are moved in forward direction. A second tension member 24 formed of a cable is wound in an opposite direction onto a drum 25 and connected to the transport car 18 at 26. The transport car can be retracted by means of this cable 24. Thereby, the transport car engages a stop 26 provided on the feed carrier 16 which is thus returned into its retracted position. Both drums 20 and 25 are bearingly supported on a common driven shaft and a clutch 28 is provided for selectively coupling said both drums 20,25 with the shaft 29.

Two forks 32 are pivotally supported around axes 33 provided on a slide 31 which can be shifted in transverse direction within guide means 30. These forks 32 form the support means for the cap 6 of the corresponding frame 5 having been brought to the reduced position 5'. These forks 32 can be moved in lateral direction so that they can centrally support the respective cap 6 also if the cutting machine assumes an off-center position.

Furthermore, the forks 32 can be tilted around the axes 33 so that they do not disturb when not being used.

Figure 5:
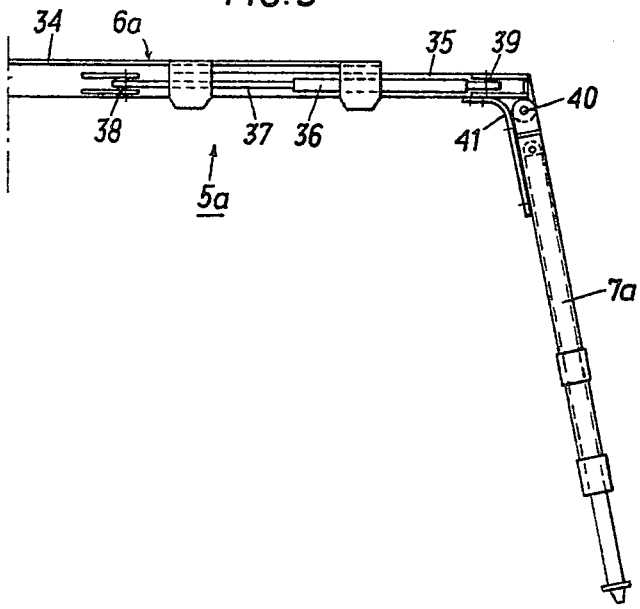
FIG. 5 illustrates consolidating frames being designed as door-jamb frames.

Besides the known curved consolidating frames shown in FIGS. 1 and 2, the construction of the provisional frames 5*a* as door-jamb frame illustrated in FIG. 5 is the most preferred within the scope of the present invention. The cap 6*a* consists of a center portion 34 in which two side portions 35 are slideably guided. These side portions can be moved in inward direction by means of a cylinder piston arrangement 36,37 for reducing the width of the frame 5*a*. The piston 37 is connected to the center portion 34 at 38 and the cylinders 36 are connected to the side portions 35 at 39. Props 7*a*, which again are designed as hydraulically operated props, are connected to the side portions 35 for being pivoted around axes 40. 41 is a leaf spring which is connected to the respective side portion 35 and prop 7*a* and is forcing the prop 7*a* in outward direction, so that the prop can more easily be kept by the operator in inclined position in which the frame 5*a* being reduced to a smaller size can be transported through the gap between the cutting machine 1 and the frames 5*a* put in place.

Figure 6:
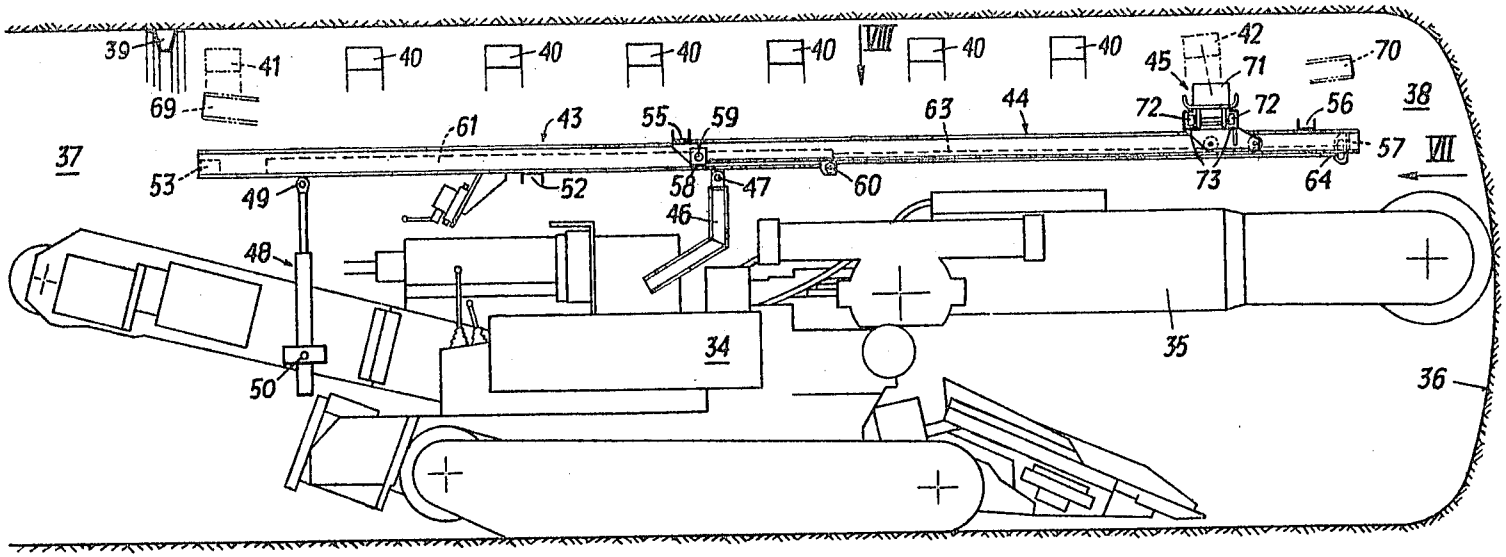
FIG. 6 shows in a lateral view of the transport means arranged on a cutting machine within the drift.

In FIG. 6 the face advancement machine is designated 34 the cutting arm of which is designated 35. The drift face is designated 36. At the area 37 behind the cutting machine the last of the erected provisional consolidating frames is collapsed and transported to the foremost area 38 and there put in place. The first erected final consolidating frame is indicated by the reference numeral 39. The provisional consolidating frame put in place is designated 40. The last provisional consolidating frame, which is to be collapsed, is designated 41 and the first provisional consolidating frame, which is to be put in place is designated 42. In any case, only the cap portions of these provisional consolidating frames are shown.

Figure 8:
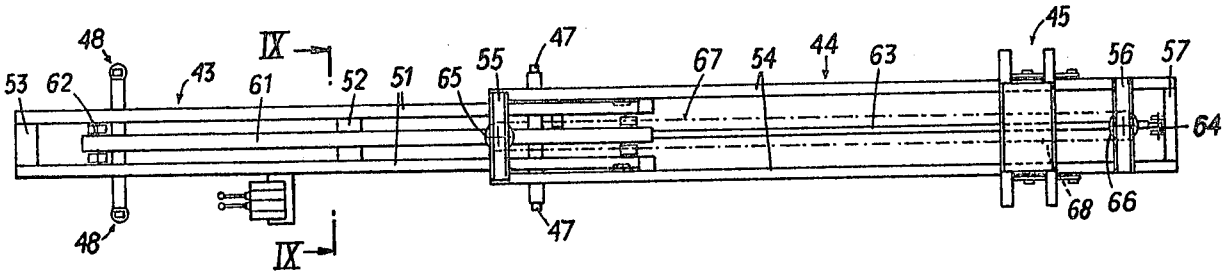
FIG. 8 represents a top plan view of the transport means in direction of arrow VIII of FIG. 6, the cutting machine being omitted.
Figure 9:
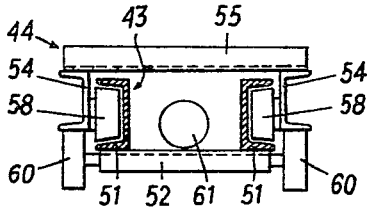
FIG. 9 represents a section along line IX—IX of FIG. 8.

According to FIGS. 6, 8 and 9, the transport device includes a longitudinal carrier 43 and a feed carrier 44 arranged for being shifted in longitudinal direction on the longitudinal carrier as well as a transport car 45 arranged for being moved on the feed carrier 44. The longitudinal carrier 43 is pivotally supported around a transverse axis 47 arranged on an arm 46 which is fixed to the face advancement machine, for example welded thereto. Piston cylinder arrangements 48 are linked to the rearward end of the longitudinal carrier 43 at 49 and these cylinder piston arrangements are linked to the face advancement machine for being swivelled around axes 50. The longitudinal carrier 43 consists of two beams 51 of U-shaped cross section with their legs directed in outward direction, said beams being connected with one another by transverse beams 52 and 53 to form a frame. The feed carrier 44 equally consists of two beams 54 of U-shaped cross section with their legs directed in outward direction, said beams being connected with one another by transverse beams 55,56 and 57 to form a frame. Wheels 58 are bearingly supported at the rearward end of the feed carrier 44, said wheels being guided between the legs of the beams 51 of longitudinal carrier 43 and being provided with axes 59. Wheels 60 are bearingly supported at the foreward end of the longitudinal carrier 43 against which wheels rest the lower legs of the beams 54 of the feed carrier 44. A cylinder 61 of a hydraulic arrangement is linked for being swivelled around an axis 52 between said two beams 51 of the longitudinal carrier 43, whereas the piston 63 of said hydraulic arrangement is linked at 64 to the forward end of the feed carrier. The feed carrier 44 can be moved by means of this cylinder piston arrangement 61,63. Guide pulleys 65 and 66 are bearingly supported on the transverse beams 55 and 56 and an endless cable 67 runs over said guide pulleys and is connected to the transport car 45 by means of a clamp 68.

For removing the provisional consolidating frame 41 located most distant from the drift face, the feed carrier 44 is completely shifted in rearward direction and the transport car 45 is completely shifted in left-hand direction on said feed carrier 44. Thus, the transport car 45 assumes a position below the provisional consolidating frame 41 to be removed. The longitudinal carrier 43 is swivelled in a position 69 indicated by dash-dotted lines, so that the transport car supports the provisional consolidating frame 41 such that this frame can be removed. Subsequently, the longitudinal carrier 43 is swivelled back into its horizontal position. The feed carrier 44 is completely moved in forward direction and a transport car 45, carrying the provisional consolidating frame collapsed to a smaller size, is moved to the foreward end of the feed carrier 44 to assume the position shown in the drawing. The longitudinal carrier 43 is, together with the feed carrier 44, subsequently swivelled in counterclockwise direction, so that the end of the feed carrier assumes the position 70 shown in dash-dotted lines. The feed carrier is thus lifting the transport car 45 and the consolidating frame 41 into the position 71, whereupon this consolidating frame is put in place and is, as the first provisional consolidating frame, now designated 42.

This transport car can be moved in transverse direction on wheels 72 running between the legs of two beams 73 of U-shaped cross section, so that the consolidating frame can be moved into the correct position.

Figure 7:
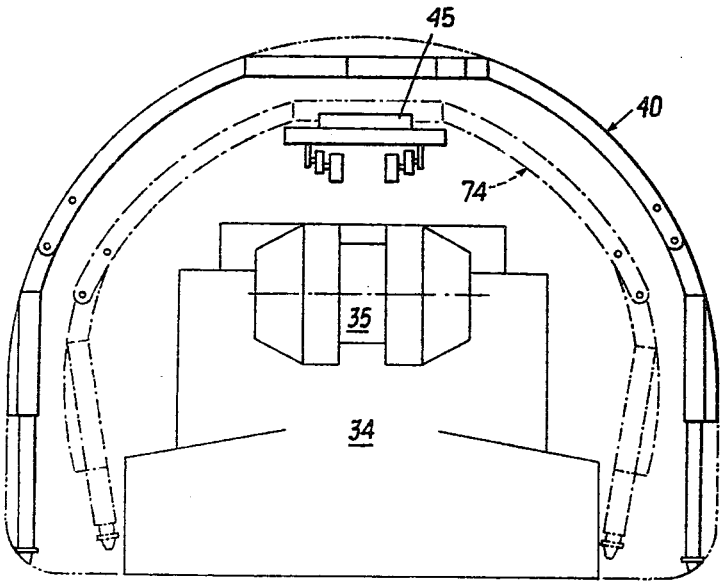
FIG. 7 represents a view in direction of arrow VII of FIG. 6.

FIG. 7 is illustrating a provisional consolidating frame 40 in its erected position by full lines. This consolidating frame is illustrated by dash-dotted lines in its position 74 as collapsed to a smaller size and is resting on the transport car 45.

What we claim is:

1. In combination with a cutting machine having at its forward end a universally pivotable arm extending forwardly, said arm carrying at its forward end a rotary cutting head: apparatus for temporarily consolidating a gallery or drift or tunnel with consolidating frames which can be reduced in size so as to be transportable through consolidating frames already in place, said apparatus comprising a longitudinally extending support have front and rear ends means fixed to the cutting machine and forming a pivot connection between the cutting machine and said longitudinally extending support such that said support is swingable relative to the cutting machine about a horizontal transverse axis which is in a fixed position relative to the cutting machine; means connected between the cutting machine and said support at a location rearwardly of said horizontal axis for selectively applying upward and downward forces to said support whereby the rear end of said support may be moved away from and toward the cutting machine; feed carrier means mounted on said support for telescopic movement parallel thereto such that the forward end of said feed carrier means may be extended longitudinally beyond the front end of said support to a position overlying the universally pivotable arm of the cutting machine; a frame transport car longitudinally movable on said feed carrier means for supporting and moving a consolidating frame, when reduced in size, from a location near the rear end of said support to a location forward of the front end of said feed carrier means; and drive means for moving said feed carrier means parallel to said support and for moving said transport car longitudinally of said feed carrier means.

2. Apparatus as in claim 1 wherein said drive means includes a drum mounted on said support, a tension member wound on said drum and guided around a first pulley mounted on the front end of said support and around a second pulley mounted on the rearward end of said feed carrier means and around a third pulley mounted on the forward end of said feed carrier means and connected to said transport car.

3. Apparatus as in claim 2 wherein said drive means further includes a second drum mounted on the rear end of said support, a second tension member wound on said second drum and connected to said transport car, and stop means on the rearward end of said feed carrier means for limiting rearward movement of said transport car.

4. Apparatus as in claim 3 wherein said first and second drums are arranged on a common drive shaft in a freely rotatable manner and wherein said first and second tension members are wound on their respective drums in opposite winding directions, said drive means further including a clutch for selectively coupling said drums with said drive shaft.

5. Apparatus as in claim 1 wherein said transport car includes a frame support for engaging a consolidating frame, said frame support being movable laterally with respect to said transport car.

6. Apparatus as in claim 1 wherein said transport car includes two upwardly directed forks for engaging a consolidating frame, said forks being pivoted for swinging movement relative to said car about axes which are generally longitudinal with respect to said feed carrier means.

7. Apparatus as in claim 1 wherein said horizontal swinging axis is located between the rear end of said support and the forward end of said feed carrier means when the latter is fully extended beyond the front end of said support.

8. Apparatus as in claim 7 wherein said swinging means acts on the rear portion of said support.

9. Apparatus as in claim 30 wherein said swinging means includes a hydraulic cylinder and piston unit linked to the rearward end of the advancement machine and to said support.

10. Apparatus as in claim 1 wherein said feed carrier means is formed of beams of U-shaped cross section having their legs outwardly directed and being connected to form a frame, wherein said transport car has wheels guided between the legs of the beams, wherein said longitudinally extending support is formed of two beams of U-shaped cross section having their legs outwardly directed and being connected to form a frame, and wherein said feed carrier means is guided between the beams of said support and is provided with wheels being guided between the legs of the beams of said support.

11. Apparatus as in claim 10 wherein the wheels on said feed carrier means are located at its rearward end, and wherein the front end of said support has wheels for supporting said feed carrier means.

12. Apparatus as in claim 1 including a hydraulic piston and cylinder unit connected between said longitudinally extending support and said feed carrier means for moving the latter parallel to said support.

13. Apparatus as in claim 1 including an endless chain connected to said transport car and guided over pulleys mounted at both ends of said feed carrier means, and means for driving one of said pulleys.

14. A machine as in claim 1 wherein said horizontal transverse axis is arranged between the rear end of said longitudinal support and the forward end of said feed carrier means when the latter is completely advanced.

15. Apparatus for temporarily consolidating a gallery or drift or tunnel with roof consolidating frames which can be reduced in size so as to be transportable through consolidating frames already in place, said apparatus comprising a longitudinally extending support having front and rear ends, said support being adapted to be carried on top of a cutting machine so as to be movable with the cutting machine toward the drift face; feed carrier means mounted on said support for telescopic movement parallel thereto such that the forward end of said feed carrier means may be extended longitudinally beyond the front end of said support to a position overlying a universally pivotable cutter arm of the cutting machine; a frame transport car longitudinally movable on said feed carrier means for supporting and moving a roof consolidating frame, when reduced in size, from a location near the rear end of said support to a location forward of the front end of said feed carrier means, said transport car including a frame support for engaging a roof consolidating frame, said frame support being mounted on said transport car for lateral movement with respect to said transport car; and drive means for moving said feed carrier means parallel to said support and for moving said transport car longitudinally of said feed carrier means.

* * * * *